US005734117A

United States Patent [19]

Tanzella

[11] Patent Number: 5,734,117

[45] Date of Patent: Mar. 31, 1998

[54] APPARATUS AND METHOD FOR TUNING VIOLINS

[76] Inventor: Anthony J. Tanzella, 2704 Oregon St., Easton, Pa. 18045

[21] Appl. No.: 767,456

[22] Filed: Dec. 16, 1996

Related U.S. Application Data

[63] Continuation of Ser. No. 397,896, Mar. 3, 1995, abandoned.

[51] Int. Cl.[6] ..... G10D 3/00

[52] U.S. Cl. ..... 84/309; 84/298

[58] Field of Search ..... 84/309, 308, 307, 84/298, 299

[56] References Cited

U.S. PATENT DOCUMENTS 3,181,409 5/1965 Burns et al. ..... 84/298
4,425,832 1/1984 Peavy ..... 84/298

*Primary Examiner*—Cassandra C. Spyrou
*Attorney, Agent, or Firm*—Charles A. Wilkinson

[57] ABSTRACT

A violin tuning arrangement and method is provided in which the bridge of the violin may be moved longitudinally along the violin by a mechanical mechanism which will automatically bring the bridge to predetermined points where a predetermined change in sound will be emitted by the violin. The mechanical arrangement includes two tuning wheels which are journaled in the sides of bridge holding brackets and may be moved discreet distances along the rack on the surface of the violin to change the tone or tuning of such violin. Discreet arrangements of teeth or detentes are provided so that the tuning wheel will tend to automatically cease movement at a point which provides a desired tuning of a violin.

21 Claims, 5 Drawing Sheets

FIG. 5
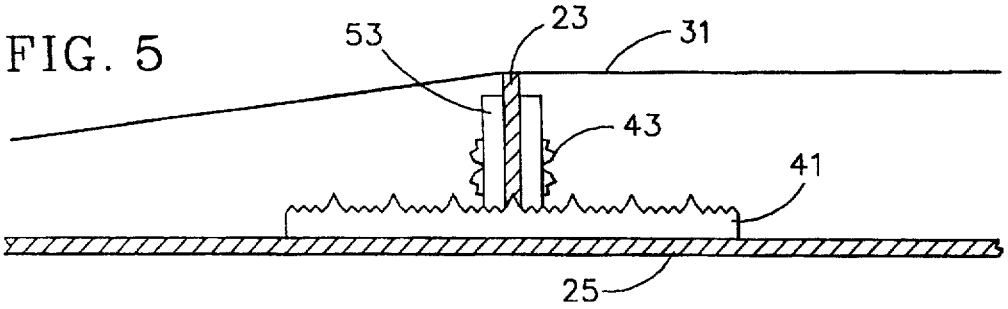
FIG. 6
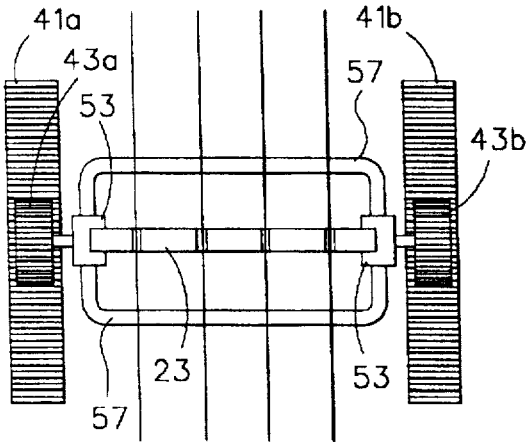
FIG. 7
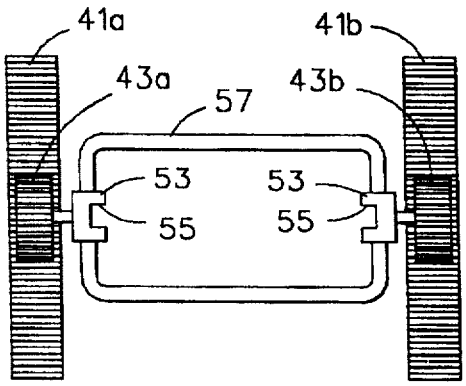
FIG. 8
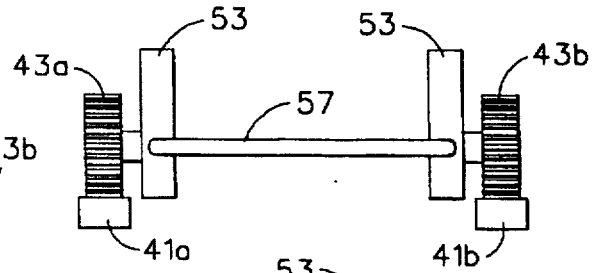
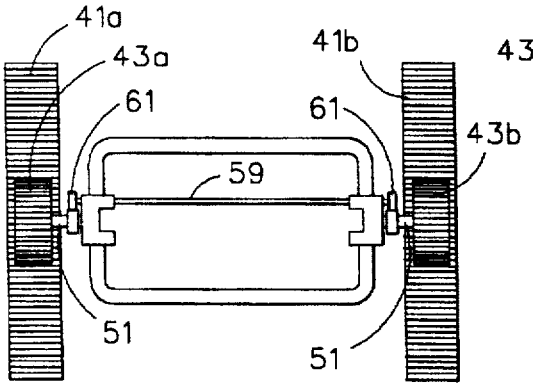
FIG. 9
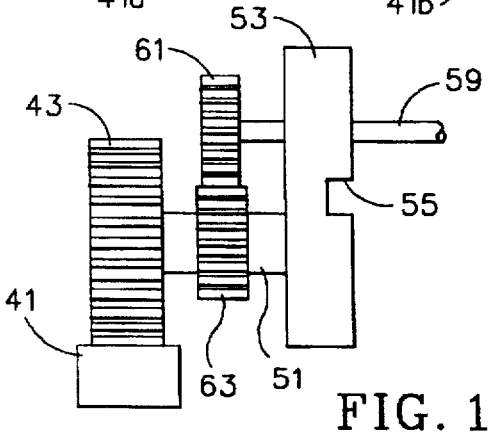
FIG. 10

FIG. 14
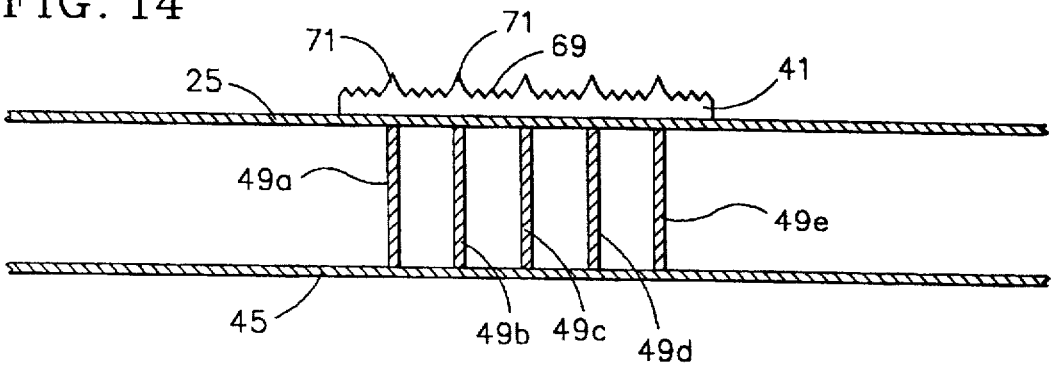
FIG. 15
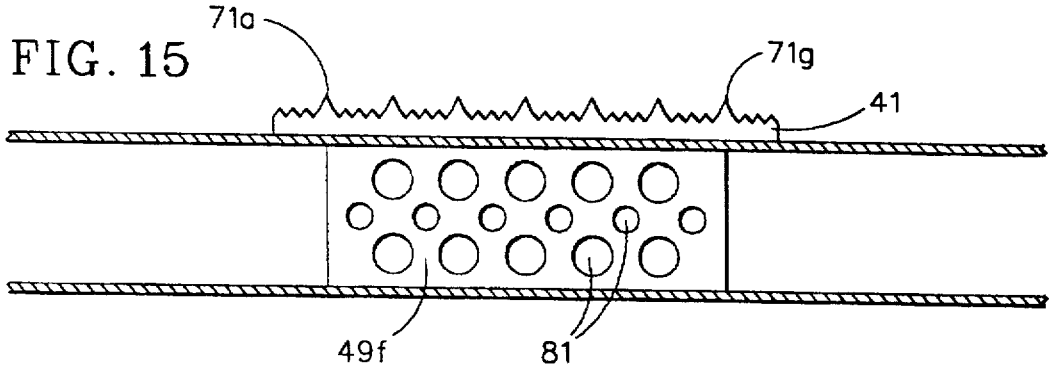
FIG. 16
| | | | | |
|---|---|---|---|---|
| G | D | A | E | 1 4/5 CENTIMETERS UP |
| | | | | 1 ½ CENTIMETERS UP |
| E | B | F | C | |
| A | E | B | F | 1 CENTIMETERS UP |
| G | D | A | E | 4/5 CENTIMETERS UP |
| D | A | E | B | ½ CENTIMETERS UP |
| G | D | A | E | NORMAL LAYOUT |
| C | G | D | A | ½ CENTIMETERS DOWN |
| | D | A | E | |
| F | C | G | D | 4/5 CENTIMETERS DOWN |
| E | F | C | G | 1 CENTIMETERS DOWN |
| | | | | 1 ½ CENTIMETERS DOWN |
| G | D | A | E | 1 4/5 CENTIMETERS DOWN |

APPARATUS AND METHOD FOR TUNING VIOLINS

This application is a continuation of application Ser. No. 08/397,896, filed Mar. 3, 1995 now abandon.

BACKGROUND OF THE INVENTION

1. Field of the Invention

This invention relates to the tuning of stringed instruments and especially to tuning violins and the like. More particularly, the invention involves the movement of the bridge of a violin longitudinally along the violin or other stringed instrument in predetermined increments in order to tune the violin or change the octave in which it plays, quickly and simply without tedious, repetitive hand tightening and finger plucking operations.

2. Description of the Prior Art

Violins and other similar stringed instruments are normally made in the form of a wooden sounding box having the form of a fairly shallow enclosure provided with thin upper and lower easily vibrated surfaces connected at the sides by somewhat more substantial supporting surfaces and vibrationally connected in the center by the sound post. An extended neck is invariably attached to the upper portion of the violin and extends outwardly from the upper end, in effect, lengthening the entire instrument. At the other end of the violin there is a sturdy attachment, referred to as the tail piece, secured to the upper surface of the violin. The tail piece serves as a place of attachment for a series of flexible strings which are passed or strung across the top of the violin and outwardly along the extension or neck where they are attached to rotatable adjustment pegs or screws within a so-called "peg box." Typically, the end of the neck is given a scroll shape to provide a more pleasing appearance. The rotatable tuning pegs, which may be turned by the fingers by means of flat handles on the outer diameter of such pegs outside the peg box section, provide a way of tensioning the strings by turning the pegs. Tensioning of the strings across the top of the violin provides a vibration medium which, when either plucked with the fingers or vibrated by drawing the side of a bow against the strings, causes such strings to vibrate giving off a sound dependent upon various factors including the tension on the strings, the length of the strings, and the force with which such strings are vibrated. The hollow body of the violin, which is physically disposed close to the strings, strongly receives their vibration and vibrates in turn amplifying the vibration because of the greater area of the surface of the sounding board or box. Meanwhile, a so-called "bridge" is normally inserted under the strings and against the top of the sounding box or sounding board and serves as a mechanical transference medium for the vibration from the string directly into the top of the sounding board. Furthermore, there is normally provided a so-called "sound post" directly under the bridge which is connected to or in contact with both the underside of the upper portion of the sound board and the underside of the lower portion of the inside of the lower portion of the sound board. The sound post, therefore, serves to transfer the vibration which is transmitted through the bridge to the top of the violin sound board directly into the bottom of the sound board to increase the entire vibration of the surfaces of the sound board and to increase the volume of the sound as well as to create overtones and the like to form a pleasing sound to the human ear, or at least to some human ears. Occasionally, such sound is too loud and discordant apparently to the ears of young children and also to the ears of many animals of keen hearing, but as the ears mature and become less sensitive to very high vibrations, the sound frequently becomes more pleasing to the listener.

As is well known, the pitch of the sound waves given off by a vibrating string depends both upon the tension in such string and the effective length of the string. The size of the sounding board also affects the pitch and many other relationships between the vibrating string and sounding board, mounting of the strings and the like, affect the final tone and tonal qualities of the sound that issues from a stringed instrument.

Normally, a violin is tuned by tightening the pegs or tension screws at the end of the neck of the violin to tension the strings and cause them to vibrate with a faster or slower motion. Typically, the musician will pluck the strings gently with his or her fingers while listening intently and adjusting the tension in the screws until the sound given off by the violin satisfies the musician's ears as to its pitch and tone. Tuning a violin takes considerable experience and is a fairly time-consuming and delicate task. Indeed, part of the skill of playing a stringed instrument such as a violin lies in the ability to hear and evaluate the tones and overtones given off when the string is plucked at various applied tensions.

A stringed instrument such as a violin, viola, cello or violoncello, bass fiddle, and the like normally have the lower portion of the strings attached to a tail piece, as explained, with the strings then extending over the bridge which is usually held against the top of the violin merely by the tension of the strings pressing the bridge against the surface of the violin. In some guitars, however, the end of the strings may actually be attached to a form of bridge which then serves as the actual end of the string. However, as indicated, the more conventional arrangement, particularly for instruments played with a bow, is for the bridge to be inserted as a tensioning member underneath the strings which then hold the bridge against the top of the violin or other stringed instrument. Usually, the bridge will be provided with small side feet that fit into very small, shallow grooves on the surface of the violin, preventing the bridge from being propelled along the surface by the pressure of the strings against the top.

Not only may the violin or other stringed instrument require tuning periodically during playing to make sure the tension in the strings remains satisfactory, but it is frequently desirable to change the pitch of the sound which the instrument will provide when the strings are stroked with the bow. Some musical compositions, however, may require higher sounds than other musical compositions and in such cases, it is customary to re-tune the violin or the like in or during intervals in the music so that it will give off a different tone or sound. Musical compositions will normally take into account this necessity for tuning and re-tuning of the instrument and allow intervals in the music and the composition during which the music is taken up by other instruments allowing the stringed instrument players to make the necessary adjustments to their instruments.

This necessity of periodically re-tuning the strings of a violin or other stringed instrument somewhat restricts the usefulness of the instrument. While a skilled musician may be able to re-tune his or her instrument in a very rapid and efficient manner in the rather small intervals of time provided in the musical composition for this operation, less skilled musicians, for example, in school bands and the like, may have considerable difficulty in re-tuning and it may at times be found that the musical composition has progressed to the point when the instrument must be played at a different octave before the musician has effectively re-tuned such instrument, requiring the musician to either play the instrument with incorrect tuning, causing a dissonance or imperfection in the sound or to require the musician to simply not play until the instrument is re-tuned to the correct pitch, in which case a section of the musical composition is frequently played without such instrument. As indicated, while very skilled musicians can frequently re-tune during very small intervals of time, which are provided by composers to provide time for such re-tuning, less skilled musicians may have various difficulties and accidents in such re-tuning, which is one reason why school orchestras and the like often have noticeably imprecise sounds issuing from them.

The present inventor has discovered that a very effective and quick method of re-tuning a stringed instrument is to move the bridge in predetermined increments along the longitudinal extent of the violin and that if such increments are predetermined, a very effective and quick method of tuning the instrument can be obtained. Applicant has also designed an apparatus for effectively moving the bridge along the longitudinal extent of the violin or other stringed instrument precise and effective intervals to provide the sound required.

OBJECTS OF THE INVENTION

It is an object of the invention, therefore, to provide a method of tuning a violin or the like by moving the bridge of such violin in longitudinal increments along the violin predetermined to provide a desired change in pitch.

It is a further object of the invention to provide an apparatus by which the bridge of a violin may be quickly and conveniently moved in predetermined increments longitudinally along such violin to change the pitch.

It is a still further object of the invention to provide an apparatus for moving a bridge longitudinally on a violin in which a series of spaced grooves are provided in or upon the surface of the violin and a rotary wheel is provided at the side of the bridge whereby, when the wheel is rotated, the bridge is moved in increments along the surface of the violin dependent upon the rotation of the wheel.

It is a still further object of the invention to provide an apparatus whereby the bridge of the violin is moved in increments longitudinally along the violin as a wheel or cog mechanism is turned at the side of the bridge and in which the cog wheel is journaled in a framework into which the bridge fits.

It is a still further object of the invention to provide a tuning device for a violin in which the violin is provided on opposite sides of the bridge with a plastic rack or the like movably interfitted with cogwheels mounted upon a frame into which the sides of the bridge are designed to fit to strengthen the bridge and prevent damage thereto as the wheels are turned to move the bridge predetermined intervals along the surface of the violin.

Other objects and advantages of the invention will become evident from a careful study of the following description and appended drawings.

BRIEF DESCRIPTION OF THE INVENTION

A method of tuning a violin and an apparatus for effecting such tuning is provided by moving the bridge of the violin predetermined intervals along the surface of the violin to re-tune the violin strings to different octaves or the like. The bridge is preferably moved along the surface of the violin by mounting the sides of the bridge in vertical frames into which a wheel or cogwheel is journaled with the cogwheels in interengagement with a rack oriented longitudinally on the surface of the violin. Equal grooves are provided in the rack to interengage with equal cogs in the cogwheel or, even more preferably, vice-versa and there are further provided at predetermined intervals deeper grooves with slightly longer cogs which serve to cause the cogwheel or grooved wheel to tend to stop at discrete predetermined intervals along the rack unless forced farther by the musician's fingers, such predetermined intervals being the normal tuning intervals of an octave, a fifth, or the like. The bridge is customarily held against the surface of the instrument by the tension in the strings passing over the top of the bridge and the cogs of the cogwheels are held within the grooves of the rack also as the result of such tension in the strings so that the apparatus for moving the bridge longitudinally does not have to be actually attached to the surface of the violin. Various means for stabilizing the rack upon the surface of the violin are possible including merely adhesively holding the rack upon the surface by either permanent or temporary adhesive, by slightly inlaying the rack into the surface, or by forming the rack as an integral portion of the surface, i.e. by machining the necessary grooves directly into the surface of the violin. Various other detent arrangements are possible in combination with the wheels of the invention to cause the wheels to tend to stop at predetermined locations along the rack providing discrete musical intervals.

BRIEF DESCRIPTION OF THE DRAWINGS

FIG. 5 is a longitudinal cross section of FIG. 3 along section line 5—5 in FIG. 3 viewed transversely in either direction.

FIG. 6 is a plan view similar to the plan view of FIG. 3 but showing a preferred embodiment including separate connections between bridge frame pieces on either side.

FIG. 7 is a plan view similar to that shown in FIG. 6, but without the bridge piece and without the strings which are normally passed over the bridge piece.

FIG. 8 is a transverse side view of the arrangement shown in FIG. 7.

FIG. 9 is a plan view of a further embodiment of the invention similar to that shown in FIG. 7, but with a rotatable coordination bar connecting the bridge support frames or brackets on each side.

FIG. 10 is an enlarged view of a portion of the tuning apparatus shown in FIG. 9 better illustrating the connection or interengagement between the coordination bar extending between the two bridge support brackets and the pinion interengaged with the shaft of the cogwheel.

FIG. 14 is a cross section of a violin in accordance with the invention showing the use of a series of sound posts or sound bars located under the normal stabilization or stopping points of the bridge to accommodate a regular series of tone differences.

FIG. 15 is a side view similar to that shown in FIG. 14, but showing a continuous longitudinal sound post or bar extending from the lowest normal position of the bridge longitudinally along the violin sounding case or box to the highest normal position of the bridge.

FIG. 16 is a diagrammatic representation of a series of related tones which can be obtained with the movable bridge of the present invention by positioning the bridge at predetermined locations longitudinally along the violin.

DESCRIPTION OF THE PREFERRED EMBODIMENTS

Figure 1:
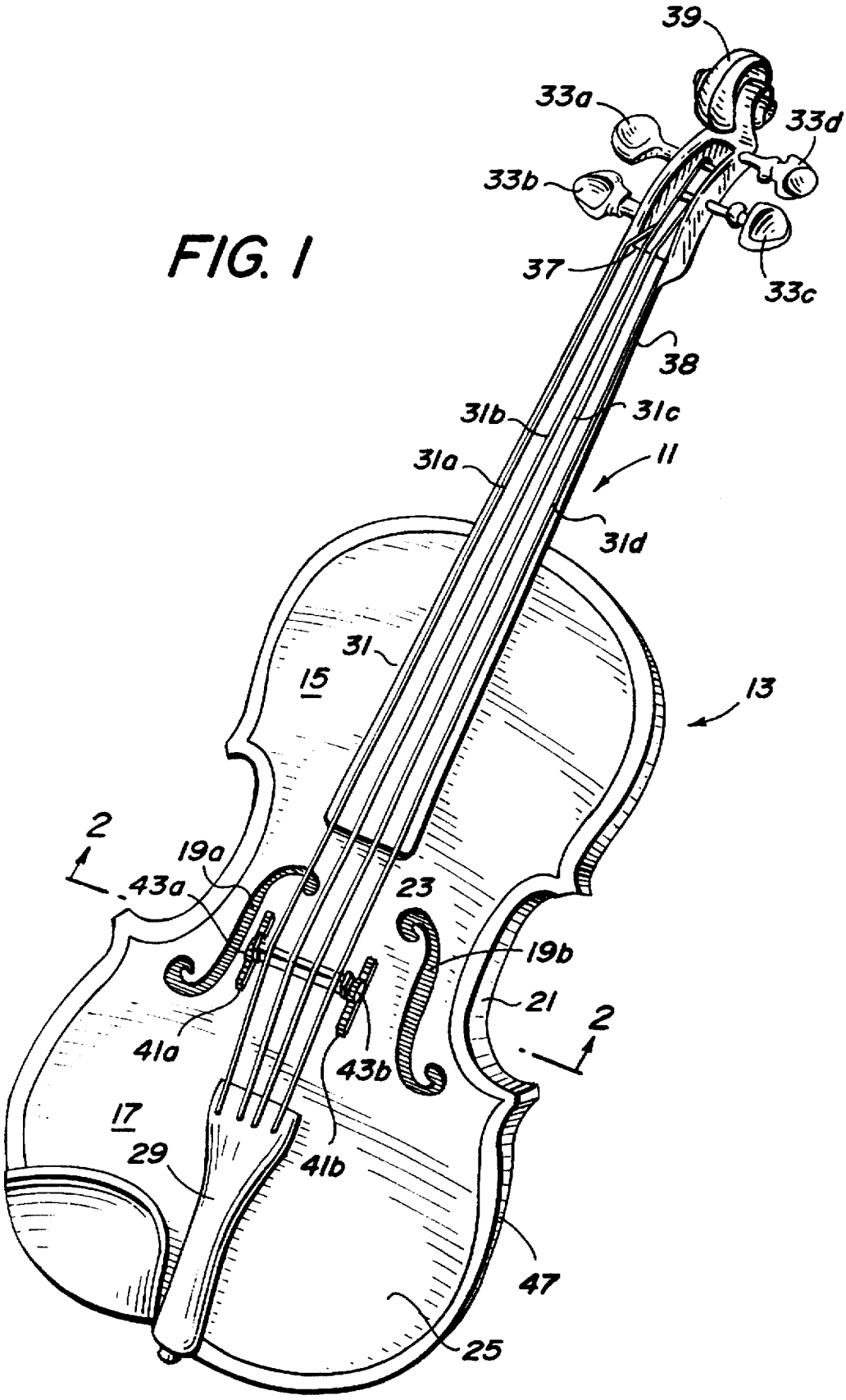
FIG. 1 is an isometric view of a typical violin provided with a tuning arrangement in accordance with the invention.

As indicated, the tuning of violins can be successfully accomplished by only experienced musicians, normally by gently plucking the string while simultaneously tightening or loosening the string by turning the pegs or screws positioned at the end of the neck of the violin. This adjustment of the pegs is time consuming. While an experienced musician may be able to accomplish the necessary adjustment in a relatively short time during periods in a musical composition especially provided by the composer for such adjustment, less experienced musicians may take so much time in adjusting the pitch of the violin or tuning the violin that they miss the next point in the musical composition when the instrument strings are supposed to be contacted again with the bow. Alternatively, the musician may be forced to stoke or vibrate the instrument strings with the bow prior to the time that the he/she has successfully finished tuning. In this case, the violin will be played out-of-tune. Some more specialized manners of tuning the violin have been invented in the past, including adjusting the bridge up or down to change the tension of the strings and by so doing change the pitch or tone. The height of the bridge has been adjustable in two basic ways: (a) by providing adjustment screws under each string to individually raise the string, thus placing additional tension on the string, or (b) by providing adjustment screws or other arrangements at the bottom of the bridge that will raise the entire bridge. As may be imagined, adjustment with individual adjustment screws for each string where it passes across the top of the bridge is most effective to change the individual tones of the strings without affecting the tones of other strings. However, to a certain extent, at least, it is easier and more convenient to change the tension in the string by rotating the adjustment pegs at the end of the neck of the violin rather than the more complicated procedure of raising the bridge or certain portions of the bridge.

Since the bridge is usually slipped under the strings and held against the surface of the violin merely by the tension of the string upon the top of the bridge, it has, to a large extent in most violins, been possible at any time to move the bridge manually. However, since it has not been possible to know exactly where to stop the bridge in its movement, it is even more convenient to merely change the tension in the string by adjustment of the tuning pegs at the end of the neck of the violin and this is what most musicians have done. Furthermore, there are almost invariably very shallow grooves in the violin surface into which small, separated feet on the bridge fit to prevent the bridge from being displaced from its normal position by the bottom slipping upon the surface of the violin.

While experienced musicians, therefore, have been able to make the tuning adjustments using the peg adjustments at the end of the neck of the violin within the time allotted in most musical pieces for such tension adjustment, less experienced musicians, for example, in high school bands and orchestras and the like, simply do not have the practice behind them to make the necessary adjustments quickly and accurately. Consequently, for such musicians and even for more experienced musicians, it would be convenient to have a quick adjustment means that would automatically adjust the tuning of the violin by predetermined increments, for example, by an octave or by a fifth or any other uniform increment.

Such quick and accurate adjustment of the tuning of a violin can now be accomplished by the use of the present inventor's arrangement for tuning such violin. Applicant has discovered that the tuning of the violin can be quickly and accurately changed if the bridge on the violin is moved longitudinally along the violin, in effect, changing the length of the string. Furthermore, the applicant has developed a simple and effective mechanical arrangement or apparatus for moving the bridge of a violin equal increments in a rapid and convenient manner without changing the manner in which the bridge is normally integrated onto the violin, i.e. by being attached to the violin merely by a jam fit which, other than for small feet on the bottom of the bridge which normally fit into small grooves in the surface of the violin, allows the bridge to be placed in different positions.

In FIG. 1 there is shown an isometric view of a typical violin 11 having a sound body or "box" 13 having, typically, an upper section 15 and a lower section 17. Conventionally f-shaped sound holes or orifices 19 are provided in the central section of the sound box adjacent to and somewhat downwardly displaced from the wasp waist 21 of the sound box. The f-shaped sound holes **19*a* and 19*b* are conventionally bracketed about the section in which a bridge 23 is normally mounted upon the upper surface 25 of the sound box. The bridge 23, may take many shapes, but usually has a slightly arcuate shape with an arcuate upper portion with notches in which the strings are mounted and frequently two outboard feet on the bottom which directly contact the upper surface 25** of the violin. The exact details of the bridge are not shown in FIG. 1, since bridges take a variety of actual shapes within the general shape described above. There are, for example, a number of patents directed to bridges of various shapes and designs, each one having certain advantages and disadvantages with respect to the others.

The bridge 23 is conventionally urged against the surface 25 of the upper portion of the sound box 13 by the tension in the strings 31 which are secured in their lower portion to the upper part of the tailpiece 29 which is mounted upon the surface 25 of the violin. The strings 31 of which there are conventionally four (4) including the G-string on the left, the D-string next to the G-string, the A-string next to the D-string, and the E-string on the extreme far right. These are given here in alphanumeric designations of **31*a* for the G-string, 31*b* for the D-string, 31*c* for the A-string, and 31*d* for the E-string. The G-, D-, A- and E-strings 31*a* through 31*d* extend from the tailpiece across the bridge 23, as indicated, and are attached to a series of tuning pegs 33***a*, 33*b*, 33*c*, and 33*d* which, by turning, are able to tune the individual strings 31*a*, 31*b*, 31*c* and 31*d*, i.e. the G-, D-, A- and E-strings by turning the tuning pegs 33. Such tuning pegs are sufficiently stiff in their rotational movement so that they will not easily give up their tension with respect to the tension in the strings attached to their small diameter winding sections, but can be fairly easily turned by the fingers of the musician because of the relative leverage relationship.

Figure 11:
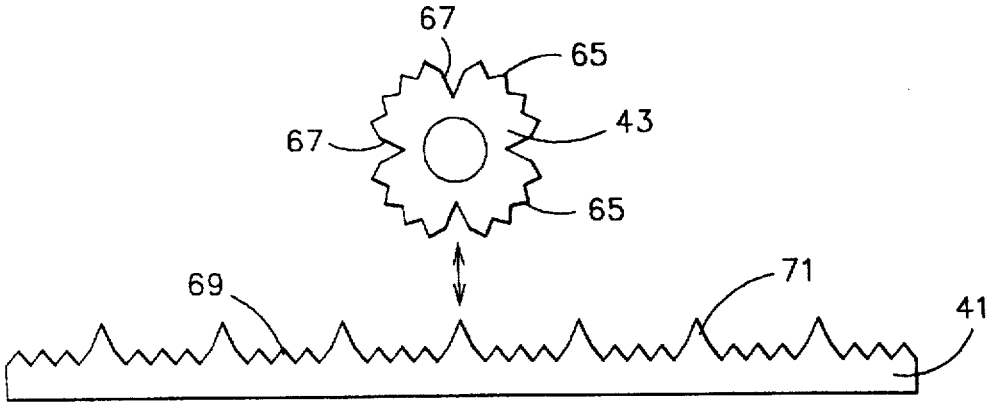
FIG. 11 is a diagrammatic enlarged view of the wheel or pinion and rack or track arrangement of the invention with the wheel slightly displaced from intermeshing with the rack.
Figure 12:
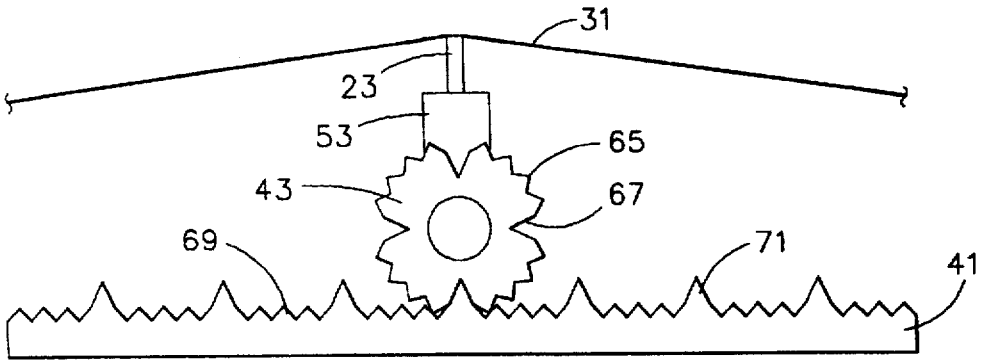
FIG. 12 is a diagrammatic view similar to that shown in FIG. 11 showing the wheel intermeshed with the rack or track and with a bridge mounted between the bridge brackets.
Figure 13:
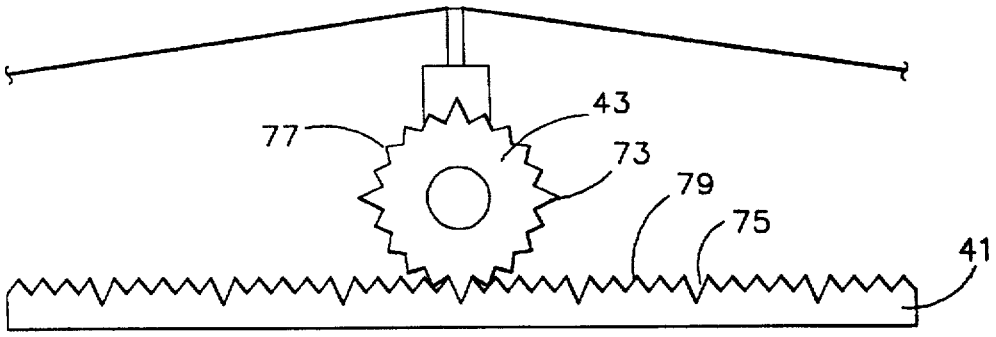
FIG. 13 is a diagrammatic side view of an alternative arrangement similar to that shown in FIGS. 11 and 12 but in which the coordinating protrusions are on the wheel rather than on the rack or track.

Mounted upon the upper surface 25 of the sounding box 13 between the f-shaped sound holes 19*a* and 19*b*, are two tracks or racks 41 on the upper surfaces of which are a series of small cogs or indentations 42 forming an elongated track or pathway. There are two tracks 41*a* and 41*b* positioned on either side of the strings 31 in a position to be contacted by two tuning wheels 43*a* and 43*b* having matching surface indentations or cogs which interact with the surface indentations or cogs on the rack or track pieces 41*a* and 41*b*. The racks or tracks 41 and cogs 42 preferably have special surface configurations which are more clearly shown in FIGS. 11 through 15 and the matching tuning wheels 43 preferably have the configurations shown in FIGS. 11 through 13 to interact with the racks 41. The particular arrangements shown in FIGS. 11 through 13 are discussed in additional detail below. However, for the present, it will suffice to say that the wheels 43 may be moved along the racks 41 by being contacted by the musician's fingers and that the wheels will tend to be halted at certain points in their travel determined by the relative construction of the rack and the wheel so that at certain points the wheel will tend to stabilize with respect to the rack or track and will not move farther without additional force being exerted to overcome the tendency to stabilize at such points. In general, as shown in the later figures, this is accomplished by having larger points or indentations in one of the two members at the points where it is desired to have the wheels stop, i.e. at even octaves, fifths, or the like. However, it will be understood that various other arrangements for tending to stop the wheel and the attached bridge at particular points longitudinally along the violin may be used. For example, spring detents might be provided to interact with spaced openings in the surface of the violin or, alternatively, in the sides or top of the racks to tend to stop the wheels at certain points. Other arrangements are also possible. In the basic embodiment of the invention shown in FIG. 1, the musician will normally use two fingers or a finger and a thumb to contact and move the two tuning wheels at one time to maintain them parallel and in synchronism.

Figure 2:
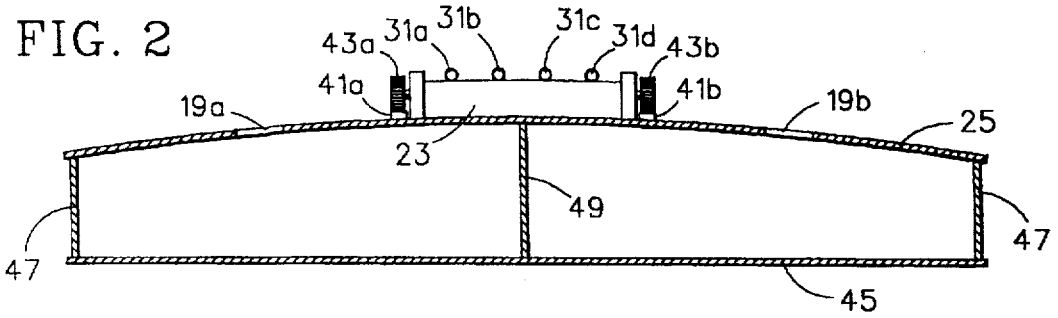
FIG. 2 is a transverse section 2—2 through the violin shown in FIG. 1 adjacent to the bridge of such violin and showing a rack or track disposed upon the surface of the violin and a frame and wheels in the sides of the bridge.

FIG. 2 is a transverse cross section of the violin shown in FIG. 1 along the section 2—2. Shown in FIG. 2 is the top surface 25 of the sound box and bottom 45 of the sound box, the sound holes 19*a* and 19*b* in the top 25 of the sound box of the violin, and lateral sides 47 of the sound box which connect the top surface 25 and the bottom surface 45. In the center is shown a sound post 49 which is normally jam fitted between the top 25 and the bottom 45 of the sound box and serves as a solid transmission means directly below the bridge 23 which transfers the vibration of the strings through the bridge 23 into the top 25 of the violin and then through the sound post 49 and into the bottom 45 of the violin. The gear racks 41*a* and 41*b* are shown secured to the top 25 of the violin longitudinally along the length of the violin as shown in FIG. 1. Likewise, the two tuning wheels 43*a* and 43*b*, which move in interengagement along the racks 41*a* and 41*b*, are shown contacting the racks. The tuning wheels 43*a* and 43*b* are each journaled upon axles 51 supported by or attached to the bridge brackets 53, which bridge brackets or supports are shown in more detail in FIGS. 3, 6 to 9, and 10. The bridge brackets have grooves 55 on the inner surfaces into which the ends of the bridge 23 fit. The grooves 55 are just large enough to contain the ends of the bridge 23 and serve not only to connect the tuning wheels 43 to the bridge 23, but also to strengthen the sides of the bridge so that it can be moved securely along the violin without cracking the bridge, which is a fairly delicate instrument. As noted above, bridges are usually provided with small feet on the outer ends, which feet fit into small grooves on the surface of the violin so that the bridge is supported from longitudinal movement, at least at the bottom. When using the arrangement of the invention, however, the small groove in the surface of the violin is eliminated and the bridge is, in essence, retained in position by the bridge brackets which are in turn, retained longitudinally by the tuning wheels except with respect to rotation of such wheels. The bridge may be further stabilized in its upright position by the fact that the bridge brackets have essentially flat bottoms which stand erect on the surface of the violin. In an alternative embodiment later described, the grooves may be retained in the surface of the violin at their normal location and comparable grooves provided at spaced locations so that the feet of the bridge are retained in such grooves at spaced locations by the tension of the strings over the top of the bridge and the bridge itself serves as its own periodic detent.

Figure 3:
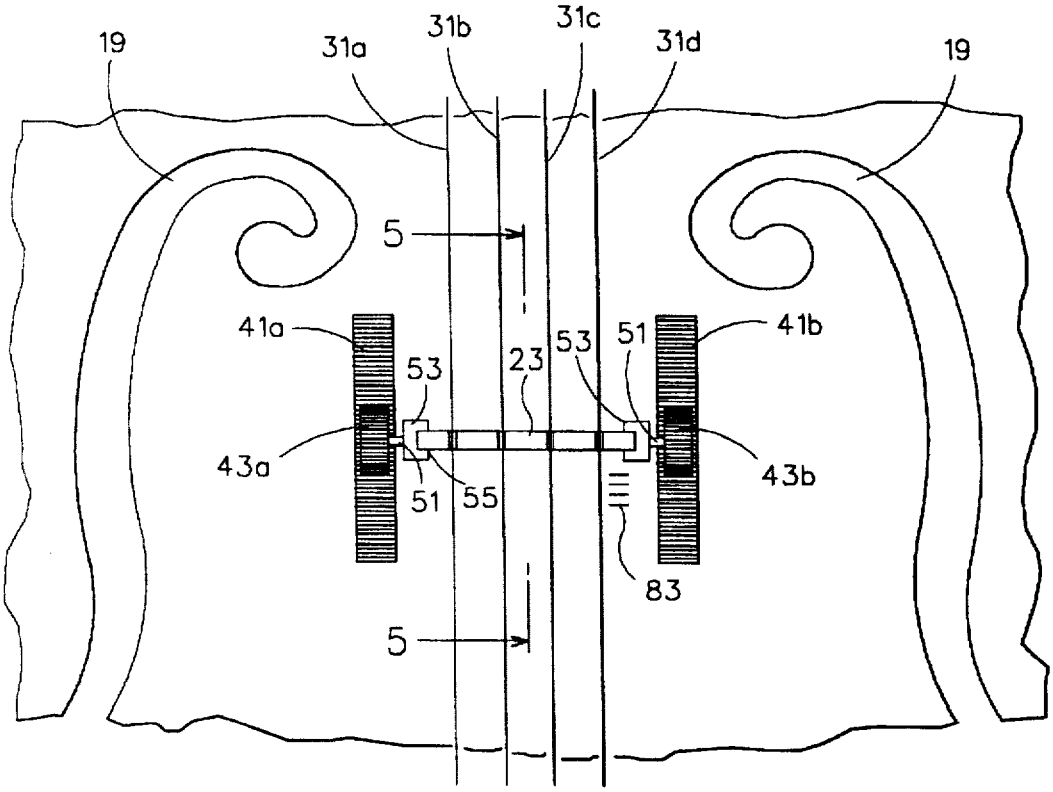
FIG. 3 is an enlarged plan view of the rack or track and pinion arrangement at the sides of the bridge including the frame in which the bridge is held rigid to allow the tuning of the violin in accordance with the invention.

FIG. 3 is an enlarged plan view of the arrangement of the invention showing the four strings of the violin 31*a* through 31*d* passing longitudinally on the violin with the racks 41*a* and 41*b* also arranged longitudinally on the violin between the sound holes 19. As shown in the previous figures, the tuning wheels 43*a* and 43*b* engage the track or racks 41 and the axles 51 of the tuning wheels 43*a* and 43*b* are journaled in the sides of the bridge brackets 53 which hold the bridge 23 in their grooves 55.

Figure 4:
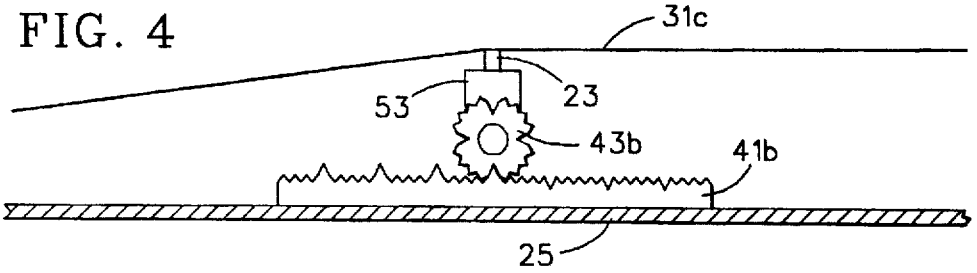
FIG. 4 is a partial side view or elevation of the arrangements shown in FIGS. 1 through 3 of a tuning arrangement for a violin in accordance with the invention.

FIG. 4 is an enlarged side view or elevation of the arrangement shown in FIG. 3 showing the diameter of the one tuning wheel 43*b* on the rack 41*b* and the string 31*d*, which is the E-string on the right side of the violin. FIG. 5 is a sectional view along the section 5—5 of FIG. 3 and shows essentially the same parts as in FIG. 4. The rack or track 41 is shown as formed from a separate section or structure secured to the top 25 of the violin. As such, it may be adhered to the top by suitable adhesive either temporarily or permanently. As will be understood, however, the rack or track could also be inlaid into the top of the violin or could be formed as a portion of the top surface of the violin itself.

FIG. 6 is a plan view similar to FIG. 3 of an improved embodiment of the invention in which all the parts are the same as in previous views but with the addition of a pair of coordinating bars 57 which are attached at their ends to the sides of the bridge brackets 53 and serve to coordinate the two bridge brackets together so that they do not have to be separately moved. The coordinating bars 57 also serve to prevent excess force from being placed on the bridge when the tuning wheels 43*a* or 43*b* are turned, possibly cracking the bridge. The bridge bar 57 also eliminates the need to strictly rotate both of the tuning wheels 43*a* and 43*b* with two adjacent fingers or a finger and thumb of the violinist during tuning. Instead, movement of the wheel on one side will be carried over to the bridge bracket on the other side, automatically moving the wheel on that bridge bracket. An even more desirable arrangement is shown in FIGS. 9 and 10 in which an additional thin rotating axle passes between the bridge brackets so the rotation of the one turning wheel will be transferred directly to the other tuning wheel. FIGS. 9 and 10 are further described below.

FIG. 7 shows the essential apparatus of the tuning device of the invention without the presence of either the strings on the violin or the bridge itself and illustrates that the basic apparatus, as shown in FIG. 6, comprises two bridge brackets 53 connected by coordinating bars 57 with tuning wheels 43 journaled in the bridge brackets 53 to rotate upon the racks or tracks 41. The arrangement shown in FIG. 7 is shown in end view in FIG. 8 as well.

FIGS. 9 and 10 are respectively an enlarged top plan view of a further improved embodiment of the arrangements shown in FIGS. 6 and 7 in which a further axle bar 59 extends between the bridge brackets 53 and is journaled in such bridge bracket to pass therethrough and be rotatably connected to the axles 51 of the tuning wheels 43*a* and 43*b*. Appropriate cog wheels 61 are provided on the end of the rotatable coordinating shaft 59, which cog wheels interengage with complimentary cog wheels 63 on the journaled shaft 51 of the tuning wheels 43. This is shown more in detail in FIG. 10. The use of the rotatable coordinating shaft 59 enables a musician to rotate either one of the tuning wheels 43*a* or 43*b* with an appropriate finger of the musician's hand and enables the other tuning wheel to also be rotated so that it is impossible for the two tuning wheels to get out of synchronism and the tuning apparatus will be propelled down the longitudinal length of the violin accurately and efficiently.

FIG. 11 is a diagrammatic side view illustrating a preferred arrangement of the tuning wheels 43 and rack or track 41 so that they are coordinated to move together and to stabilize or stop at predetermined points which are multiples of musical intervals so that the violin can be quickly and effectively adjusted from one tuning point to another. As shown in FIG. 11, a tuning wheel 41 is provided with small indentations 65 and relatively larger indentations 67. The wheel 41 is shown lifted from the surface of the rack 41. However, when the wheel 43 is moved downwardly to interengage with the rack 41, which it will be understood is on the surface 25 of the violin or top of the sound box, the small indentations 65 will interengage with small teeth 69 on the surface of the rack 41 while the large indentation 67 on the wheel will coordinate with large teeth 71 on the surface of the rack. It will be understood that the distances between the large indentation 67 and the circumference of the wheel 43 will be coordinated with the distances between the large teeth 71 on the surface of the rack 41. Consequently, when the wheel 43 moves along the rack 41, as shown in FIG. 12, the wheel will tend to stabilize directly over the large tooth on the rack when such large tooth completely fills the large indentation 67 in the wheel. However, the stabilization of the wheel over each large tooth 71 is not so complete that the wheel 43 cannot be moved along the rack 41 by the exertion of additional force. Once the wheel starts to leave the surface of the rack in the vicinity of the large tooth, the small teeth 69 on the surface of the rack 41 interengage with the small indentation 65 on the surface of the wheel and such wheel tends to move smoothly along the rack until the next large tooth 71 enters into the large indentation 67 in the face of the wheel.

FIG. 13 shows an alternative embodiment of a wheel and rack arrangement in which large teeth 73 are found on the wheel 43 rather than on the rack 41 and the large indentations 75 are found on the rack 41 rather than the wheel as shown in FIGS. 11 and 12. Likewise the small teeth 77 are found on the wheel and the small indentations 79 are found on the rack in FIG. 13. Otherwise the arrangement and operation of the arrangement shown in FIG. 13 is the same as shown in FIGS. 11 and 12. Normally it is more convenient to have the indentations on the wheel as shown in FIGS. 11 and 12 rather than on the rack, since it is the wheel which will be rotated by the fingers and the large teeth on the wheel, while not large relative to the fingers of a musician, could over a time period possibly irritate the skin on such fingers, whereas having indentations in the wheel merely aids the finger in gaining a good grip with the wheel as it is moved.

FIG. 14 is a longitudinal section view of a violin box transverse to that of FIG. 2 showing a modified arrangement of multiple sound posts 49 each arranged to be directly under one of the large teeth 71 of the rack on the surface 25 of the sound box of the violin. The arrangement shown in FIG. 14 assures that the vibrations from the strings into the bridge are transported directly through the bridge into the top 25 of the violin and then to the bottom 45 of the violin box through a sound post one of which is always under the large teeth 71. Consequently, the sound is always transmitted directly into the top 25 of the violin and then through a sound post 49 into the bottom 45 of the violin.

FIG. 15 shows an alternative arrangement in which a continuous sound post 49F extends from the first large tooth 71A at one end of the rack 41 to the last large tooth 71G at the opposite end of the rack 41. The continuous sound post 49F is shown in FIG. 15 with spaced orifices 81 in it to make it act somewhat more like a single post extending from the bottom to the top of the violin under each large tooth 71. The spaced orifices 81 also do not interfere as much with reverberations of sound waves within the sound box of the violin. Since the arrangement of the sound post as well as the construction of the entire violin including the sound holes 19 and the shape of the lower and upper sections 15 and 17 of the violin are critical to particular sound qualities, it will be understood that certain adjustments may be necessary in the arrangements of the tuning apparatus of the invention combined with the sound post or posts to provide the tonal quality from the violin desired.

FIG. 16 illustrates typical distances of movement for the bridge on a typical violin to obtain particular sounds from the violin. In the center of the diagram is shown the position for the normal string layout in which the string on the left is the G string, the string next to that is the D string, the string next to that is the A string, and the string on the right is the E string. Moving the bridge one-half centimeter up as shown in the diagram in FIG. 16 will change this arrangement so that the string on the left will be D, the one next to that will be A, the next to that will be E and the one next to it will now be B. Moving up to four-fifths of a centimeter the relationships will be changed to G, D, A and E in the higher register, while at one centimeter up the change will be from E B F C. Normally as shown the bridge will not be moved more than about one and four-fifths centimeter up or one and four-fifths centimeter down, because to do so might significantly change the tension in the string. Moving the bridge longitudinally along the violin will in the conventional violin change the tension in the strings due to the fact that the strings are attached to the violin at a higher level on one end than at the other end so that moving the bridge, which is another high point, in effect makes the strings slightly longer or shorter decreasing or increasing the tension on such strings. Consequently, the changes in tuning which are effected by the movement of the bridge in a violin in accordance with the present invention are due not only to small changes in effective length of the strings between points at which such strings are effectively secured to the violin, but also to changes in tension in the strings. Consequently, the actual changes in tuning are due to several factors. As indicated above, because of the critical relationships of all the parts of a violin, furthermore, changes in overtones and other relationships of the sound will also be expected. However, it has been found that by carefully coordinating the various relationships with the movement of the bridge in accordance with the present invention a very effective quick and convenient change in the tuning of the violin can be made. An arrangement in accordance with the invention allows a note out of the normal range of the instrument to be easily and conveniently played with one quick adjustment and allows higher and lower notes to, in general, be conveniently played, than was previously possible.

As indicated above, a practical means for stopping the movement of the bridge at desired locations in accordance with, for example, the data provided in FIG. 16 (which is for a particular, though typical, violin) can include the use of a fairly sturdy bridge formed of plastic or the like rather than the more usual wood and having feet on the outside bottom as is more or less conventional. Referring to FIG. 3, imagine that the opposed teeth and indentations on the tuning wheels and rack or tracks are uniform and that shallow grooves 83 designed to accommodate the feet are formed in the surface of the violin as shown. The feet on the bridge combined with the strings pressing on the top of the bridge will in such an arrangement serve as their own periodic detents to stabilize the bridge at periodic intervals.

While the present invention has been described at some length and in some particularity with respect to several described embodiments, it is not intended that it should be limited to any such particular embodiments or any particular embodiment, but is to be construed broadly with reference to the appended claims so as to provide the broadest possible interpretation of such claims in view of the prior art and therefore to effectively encompass the intended scope of the invention.

I claim:

1. A method of tuning a stringed instrument adapted to be stroked with a bow and having a string supporting bridge positioned adjacent the center of said instrument comprising:

(a) moving said string supporting bridge longitudinally of said stringed instrument upon which the bridge is supported while continuing to support the strings over the bridge from a first position at which a string of the instrument has a certain tone, (b) terminating the movement of the bridge at a second predetermined position upon the stringed instrument providing a standard musical interval with respect to tuning the strings of said instrument from the first position, the distance between the first and second positions having been previously determined to provide a standard musical interval tone change in the string from the first position of the bridge, (c) stroking the strings to provide a tone altered from the tone that would have been provided at the first position by the standard musical interval, (d) wherein the step of moving the bridge is effected by rotating a wheel operatively secured to the bridge by hand contact and the step of terminating movement of the bridge is effected by resisting continued movement by a resistance engendering arrangement which increases resistance to movement of the wheel at predetermined points along the travel of the bridge and the wheel operatively secured thereto.

2. A tuning apparatus for a stringed instrument comprising:

(a) a stringed instrument having a sounding box, across which a plurality of tensioned strings extend, (b) two parallel tracks provided on a surface of the sounding box of the stringed instrument parallel to the strings and adjacent to a bridge over which the strings of the instrument extend, (c) two opposite adjustment wheels adapted for contact with and movement along the parallel tracks, (d) said adjustment wheels being rotatably attached to side support means for said bridge and being rotatably movable by a force exerted upon said wheels along said tracks, and (e) a means for increasing the resistance of the wheels to movement along the tracks at predetermined positions along the tracks with respect to bridge positions along the strings, the distance between the positions being such as to provide a change in tone of the strings by a standard musical interval.

3. A tuning apparatus in accordance with claim 2 wherein the parallel tracks and adjustment wheels are provided with interengaging raised and depressed portions which limit travel along the tracks by the wheels to a predetermined amount of rotation such as to provide the change in tone of the strings by the standard musical interval and wherein the means for increasing the resistance of the wheels to movement along the tracks comprises an easily overridden detaining means.

4. A tuning apparatus in accordance with claim 3 wherein the easily overriden detaining means is separate from the wheels.

5. A tuning apparatus in accordance with claim 3 wherein the easily overrideable detaining means is incorporated in at least one of the wheels.

6. A tuning apparatus in accordance with claim 5 wherein the interengaging raised and depressed portions comprise a series of relatively raised portions being positioned on one of the wheels and tracks and a series of coordinated depressed portions positioned on the other of the wheels and tracks.

7. A tuning apparatus in accordance with claim 6 wherein the depressed portions are on the wheels and the relatively raised portions are on the tracks.

8. A method of tuning stringed instruments adapted to be stroked with a bow and having a bridge near the center of said instrument over which the strings are extended comprising:

(a) moving a bridge of a stringed instrument from a first position longitudinally of the instrument while supporting the strings of the stringed instrument over the bridge, the movement of the bridge being attained by hand rotation of a wheel operatively secured to the bridge, and (b) terminating movement of the bridge at a second position longitudinally of the instrument previously determined to provide a desired musical interval change from the first position of the bridge said movement being terminated by resistance to continued movement provided by a resistance engendering arrangement which increases resistance to movement of the wheel at predetermined points along the travel of the bridge and the wheel.

9. A tuning arrangement for stringed instruments comprising:

(a) a stringed instrument having a sounding box with strings passing over the sounding box, (b) a bridge supporting the strings and displaceable longitudinally of the instrument along a portion of the surface of the sounding box, (c) said bridge being at least temporarily connected to a positioning means by which the bridge is moved longitudinally of the stringed instrument and positioned at discrete predetermined positions longitudinally which represent standard musical interval positions along the strings at which positions the tone provided by the strings is changed at least a discrete musical interval from one bridge position to another.

10. A tuning arrangement for stringed instruments in accordance with claim 9 where the positioning means is provided with easily overridden detaining means adapted to detain the bridge at the predetermined positions along the strings separated by distances providing tone changes of at least a discrete musical interval.

11. A tuning arrangement for stringed instruments in accordance with claim 10 additionally comprising:

(d) at least one track positioned parallel to the strings upon the surface of the sounding box, (e) said positioning means being at least partially interengaged with the track.

12. A tuning arrangement for stringed instruments in accordance with claim 11 wherein the positioning means includes a wheel providing interengagement between the track and the positioning means as it rotates in contact with the track.

13. A tuning arrangement for stringed instruments in accordance with claim 12 wherein the wheel is journaled in a slotted brace in a slot of which one side of the bridge is held.

14. A tuning arrangement for stringed instruments in accordance with claim 13 wherein another slotted brace is provided on an opposite side of the bridge another wheel is jounaled in said another slotted brace, with at least one of said wheels being in contact with the track on the surface of the sounding box.

15. A tuning arrangement for stringed instruments in accordance with claim 14 wherein the wheels and track are provided with interengaging extensions and indentations.

16. A tuning arrangement for stringed instruments in accordance with claim 15 wherein there are provided matching periodic larger extensions and depressions on the wheels and track interspersed with relatively smaller extensions and depressions spaced at discrete distances from each other providing discreet musical intervals with respect to the tone provided by the strings upon stroking.

17. A tuning arrangement for stringed instruments in accordance with claim 16 wherein the slotted brace on said one side of the bridge is connected to the another slotted brace.

18. A tuning arrangement for stringed instruments in accordance with claim 17 wherein the connection of said slotted brace with the another brace comprises one or more connecting bars.

19. A tuning arrangement for stringed instruments in accordance with claim 18 additionally comprising:

(f) a rotatable connecting means which connects the wheels journaled upon each slotted brace and coordinates rotation with each wheel with respect to its respective track.

20. A tuning arrangement for stringed instruments in accordance with claim 9 additionally comprising:

(d) a longitudinally extended sound post within the sounding box having a longitudinal length at least substantially coextensive with a range of possible movement of the positioning means longitudinally along the sound box.

21. A tuning arrangement for stringed instruments in accordance with claim 20 wherein the extended sound post comprises a discontinuous series of separate longitudinally aligned sound posts.

* * * * *